US006030293A

United States Patent [19]

Takeda

[11] Patent Number: 6,030,293

[45] **Date of Patent: *Feb. 29, 2000**

[54] GOLF CLUB

[75] Inventor: Hitoshi Takeda, Tsubame, Japan

[73] Assignee: Kabushiki Kaisha Endo Seisakusho, Niigata, Japan

[ * ] Notice: This patent is subject to a terminal disclaimer.

[21] Appl. No.: 09/116,175

[22] Filed: Jul. 16, 1998

[30] Foreign Application Priority Data

Nov. 20, 1997 [JP] Japan ..... 9-319820

[51] Int. Cl.[7] ..... A63B 53/04

[52] U.S. Cl. ..... 473/334; 473/345; 473/349; 473/350

[58] Field of Search ..... 473/345, 346, 473/349, 350, 330, 331, 332, 334, 335, 336, 337, 338, 339

[56] References Cited

U.S. PATENT DOCUMENTS

| | | |
|---|---|---|
| 4,852,880 | 8/1989 | Kobayashi . |
| 4,883,274 | 11/1989 | Hsien . |
| 4,964,640 | 10/1990 | Nakanishi . |
| 5,184,823 | 2/1993 | Desbiolles . |
| 5,207,427 | 5/1993 | Saeki . |
| 5,346,216 | 9/1994 | Aizawa . |
| 5,421,577 | 6/1995 | Kobayashi . |
| 5,465,968 | 11/1995 | Aizawa . |
| 5,522,593 | 6/1996 | Kobayashi . |
| 5,720,673 | 2/1998 | Anderson . |
| 5,807,189 | 9/1998 | Martin . |
| 5,899,820 | 5/1999 | Minematsu . |

FOREIGN PATENT DOCUMENTS

| | | |
|---|---|---|
| 62-201168 | 9/1987 | Japan . |
| 8-38657 | 2/1996 | Japan . |
| 9-24125 | 1/1997 | Japan . |

*Primary Examiner*—Sebastiano Passaniti
*Attorney, Agent, or Firm*—Quarles & Brady LLP

[57] ABSTRACT

A golf club with which you can strike a strong ball with a sharp feeling in striking as well as an enlarged sweet area. A concave portion 19 is formed at a rear side of a head body 16. A metallic balance weight 17 is fitted into the concave portion 19. A cover 18 for covering the balance weight 17 is fixed to the rear side of the head body 16. The specific gravity of a material for the balance weight 17 is smaller than that of the head body 16. Accordingly, a more sharp feeling in striking can be obtained as compared to a conventional head whose concave portion is hollow. Additionally, a sweet area can be enlarged owing to the weight distribution biased toward the periphery. The specific gravity of a material for the cover 18 is at least equal to that of the material for the head body 16. As a result, the depth of the center of gravity is made greater, thereby further widening a sweet area.

9 Claims, 6 Drawing Sheets

GOLF CLUB

BACKGROUND OF THE INVENTION (a) Field of the Invention

The present invention relates to an iron golf club, specifically to a head structure thereof.

(b) Description of Prior Art

Typically, iron golf clubs have two types, i.e., muscle back type and cavity back type. A head of cavity back type is formed with a cavity provided at a back side of a head body having a striking face, while a head of muscle back type, which is more conventional than the former, is free of such a noticeable concave as that of the cavity back type.

With a head of muscle back type, you can obtain a sharp feeling in striking balls, and strong balls can be struck using this type of head. The "strong balls" is meant here as balls that travel comparatively straight, without being influenced by the wind, due for example to good spins of balls. On the other hand, such muscle back type head has a drawback such that it has a comparatively small sweet area or an area on a face within which a ball travels well when struck thereon. In contrast, a head of cavity back type has advantages such that owing to its cavity, its face can be enlarged without making the total weight of the head heavier, and the weight can be distributed toward the peripheral portion thereof so that a moment of inertia of the head is enlarged so as to enlarge a sweet area. In other words, if you strike a ball at a position away from the foot of a perpendicular line from the center of gravity of the head to the face, the deflection of the head would be lessened, thus decreasing so-called mis-shots. With the cavity back type, however, so-called "striking core" would be made unclear when striking balls, thus leading to an inferior feeling in striking.

In Japanese Patent Application Un-Examined Publication No.8-38657, there is proposed a golf club head which is an intermediate type between the muscle back type and the cavity back type, which comprises a recess formed at the back side of a head body, and a balance weight fitted into said recess, said balance weight being made of a material having the smaller specific gravity than that of the head body. According to such conventional structure, a good feeling in striking balls relatively close to that of the muscle back type is able to be obtained, with the effect of the weight distribution toward the periphery being ensured to some extent. However, the head according to the above No.8-38657 publication has a material of comparatively large specific gravity located at its face side, while another material of comparatively small specific gravity located at its back side, so that so-called the depth of the center of gravity (or a distance from the face to the center of gravity of the whole head) is made comparatively small. Whilst the deepening of the center of gravity as well as the suitable weight distribution toward the periphery of the head is generally recognized as means for enlarging a sweet area, the conventional head of the No.8-38657 publication has such a small depth of the center of gravity that a sweet area also is narrowed comparatively.

Referring to another prior art described in Japanese Patent Application Un-Examined Publication No.9-24125, it discloses, although an object of its invention is somewhat different, an iron golf club head comprising a head body with a recess formed at the back thereof, a rubber-like elastic body fitted into said recess and a cover (rear face member) which covers the elastic body and is fixed thereto by screws. According to this conventional head, the specific gravity of a material of the cover is greater than that of a material of the head body in order to enlarge a sweet area. The prior head has indeed an advantage that the struck balls are able to travel a longer distance owing to the elasticity of the rubber-like elastic member. However, you cannot obtain so good a feeling in striking balls as the muscle back type head, since the member provided at the rear side of the face is no more than a rubber-like elastic body. In addition, as the head described in No.9-24125 publication has the cover fixed by screws, the attractiveness of the head would be impaired.

Incidentally, welding, for example, can be thought of as means for fixing the cover to the head body. With the welding, however, there would remain welding marks and /or pin holes, and thus it also impairs the attractiveness of the head. Further, as welding is sometimes impossible, depending on the materials of the head body and/or the cover, the selection of the materials would be restricted. In addition, in the case of plating, some metallic materials indicate inferior adherence in plating.

SUMMARY OF THE INVENTION

To eliminate the above-mentioned problems, it is, therefore, an object of the present invention to provide a golf club having a head which realizes a sharp feeling in striking balls and enables the striking of strong balls, with a sweet area being enlarged.

To attain the above object, a golf club of the invention comprises a golf club incorporating a head having a shaft connected to one side and a face on a front, wherein said head comprises: a metallic head body formed with a cavity comprising a hollow portion in a rear face; a metallic balance weight fitted into the cavity of said head body;

and a metallic cover joined to a rear side of said head body so as to cover said balance weight, wherein the specific gravity of a material of said balance weight is smaller than that of a material of said head body, while the specific gravity of a material of said cover is at least equal to that of the material of said head body,

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DESCRIPTION OF PREFERRED EMBODIMENTS

Figure 1:
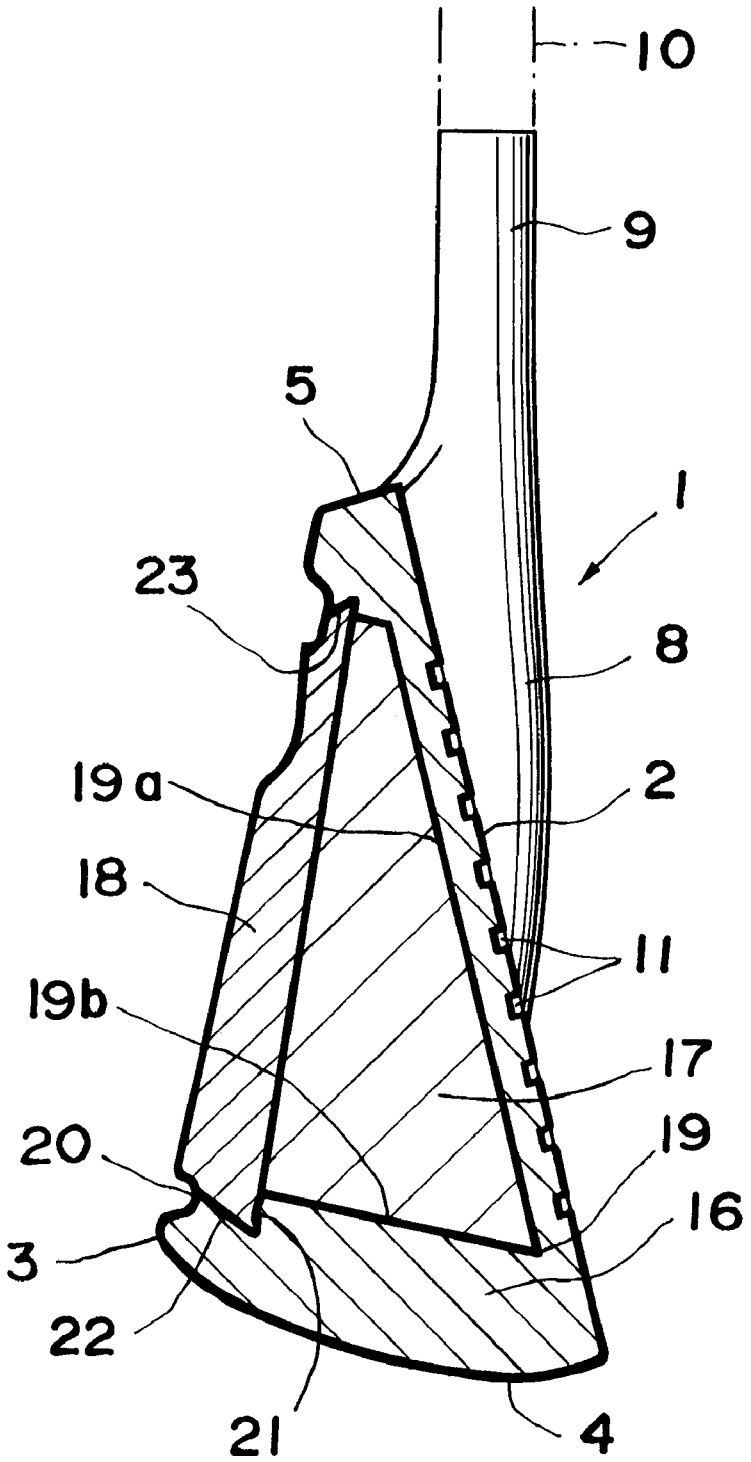
FIG.1 is a section showing a first embodiment of a golf club of the invention.
Figure 2:
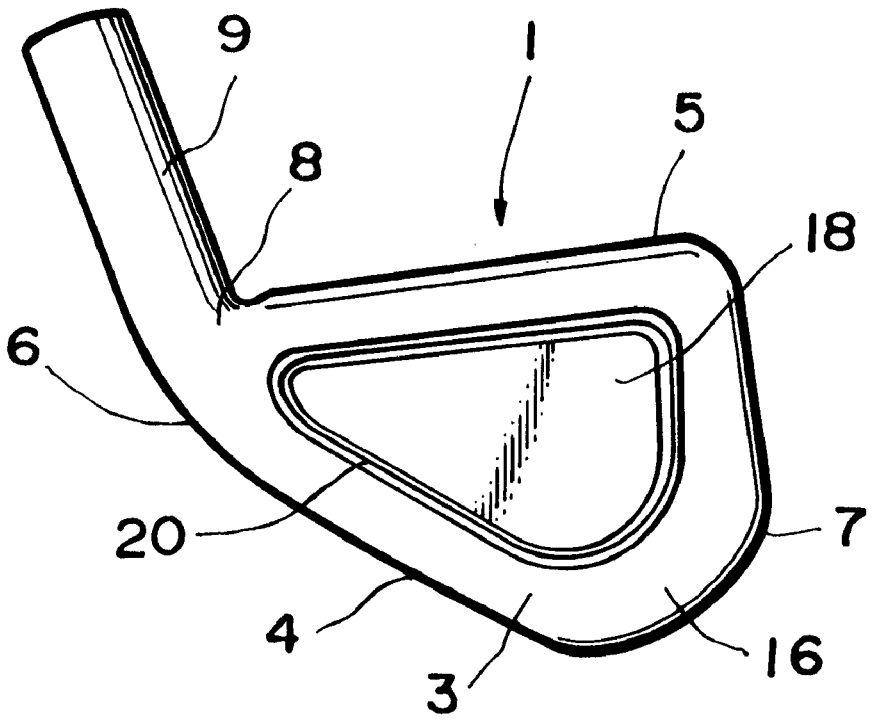
FIG.2 is a perspective view of the first embodiment of the invention.
Figure 3:
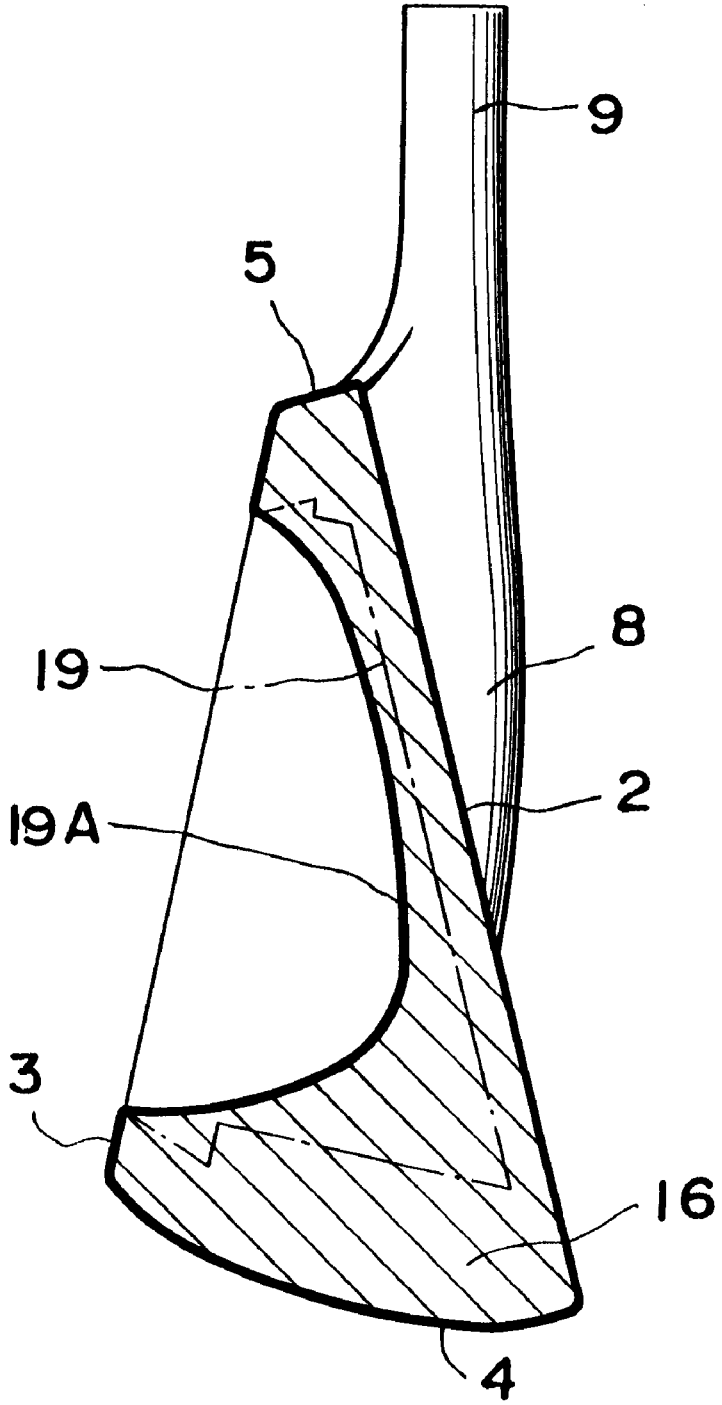
FIG.3 is a section showing a head body prior to machining a concave portion of the first embodiment of the invention.

Hereinafter is described a first embodiment of the invention with reference to FIG.1 through FIG.3, which shows an iron golf club.

Reference numeral 1 designates a metallic golf club head, which has a face 2 on its front surface, a back 3 at its back side, a sole 4 at its lower side, a top 5 at its upper side, a heel 6 at its proximal side and a toe 7 at its distal side, respectively. Said heel 6 is formed with a neck 8, from which extends upwardly a hosel 9. This hosel 9 serves as a shaft connector for connecting a shaft 10 therewith. Said face 2 is formed with a plurality of nearly horizontal concave grooves 11 called score lines.

Said head 1 consists of a metallic head body 16 which forms the entire portion of the head 1 except the back 3, a metallic balance weight 17 fitted from the rear side into the head body 16 and a metallic cover 18 fixed securely to the back side of the head body 16, covering the balance weight 17. In this embodiment, the cover 18 is formed nearly tabular, which however may be curved or formed to any other suitable configuration. It should be noted that the specific gravity of the material of the balance weight 17 is smaller than that of said head body 16, while the specific gravity of the material of said cover 18 at least equal to that of the material of said head body 16.

In this embodiment, the materials of said head body 16 and cover 18 are the same iron-based metal having comparatively large specific gravity, such as stainless steel or the like, while the material of said balance weight 17 is titanium or titanium alloy. However, the materials of said head body 16, balance weight 17 and cover 18 should not be limited to the above-described, but various other materials may be used. For example, the material of the balance weight 17 may be either magnesium-based or aluminum-based light metallic one besides the iron-based ones. The value of the specific gravity of the material of the balance weight 17 is desirably seven or below. On the other hand, the material of said cover 18 may be heavy metallic one besides the iron-based ones, such as copper, beryllium copper, tungsten, brass or lead. Whilst the material of the head body 16 having the face 2, must have a strength high enough to withstand the striking impacts of balls, the materials of the balance weight 17 and cover 18 do not have to be so strong as that of the former, and thus, a material of a lower strength may be used. For example, tungsten, which is a heavy and hard but fragile material, can be used for the material of the cover 18. Likewise, aluminum, which is a light and soft material, can be used as the material of the balance weight 17.

Said head body 16 is formed at its back 3 side with a concave portion 19 except its peripheral portion. Said balance weight 17 is fitted into the concave portion 19, with said cover 18 covering a rear opening of the concave portion 19. Whilst the rear surface of the head body 16 is positioned nearly flush with the rear surface of the cover 18, there is a concave groove 20 formed in a boundary portion between the head body 16 and the cover 18 on the rear surface.

Next, the processing of the concave portion 19 is explained.

Whilst the head body 16 is basically manufactured by cold or hot die-forging of one or more times, said concave portion 19 is formed by machining also. The die-forging is carried out by using an upper die and a lower die which move toward or away from each other. FIG.3 shows the head body 16 which is after being forged but prior to being machined. At this stage, the back 3 of the head body 16 is formed with a concave portion 19A or the predecessor of the concave portion 19, said concave portion 19A being curved moderately at obtuse angles to avoid undercut shape relative to the opening and closing direction of a pair of the dies. Thereafter, the concave portion 19A is machined more deeply to form the aforesaid concave portion 19, using a cutting device equipped for example with an end mill having a rotational shaft with a cutting blade at its end and a spiral blade on its outer surface. Thus, the concave portion 19 is finally formed to an undercut configuration, with its front face 19*a* intersecting with its lower face 19*b* at acute angles. Incidentally, the front face 19*a* of the concave portion 19 is nearly parallel with the face 2.

Said balance weight 17 is fitted into the concave portion 19 of the head body 16 by press-fitting, using a press device or the like. If this press-fitting employs for example a dovetail joint, the more rigid joint of the head body 16 with the balance weight 17 will be insured. However, as the cover 18 is fixed securely to the head body 16, covering this balance weight 17, the joint of the head body 16 with the balance weight 17 does not have to be so rigid.

Said cover 18 is joined to the head body 16 by press processing, using the hereinafter-explained joining means.

The back 3 of the head body 16 is provided with a spot facing 21 formed along an entire periphery of the concave portion 19, said spot facing 21 being formed by machining or the like. The spot facing 21 has a peripheral side face 22 whose spanwise dimension is getting smaller towards the rear, so that it is so-called reverse-tapered. On the other hand, the cover 18 has a peripheral side face 23 that is tapered, corresponding to said side face 22 of the spot facing 21, with its spanwise dimension being slightly greater than that of the side face 22 of the spot facing 21.

The cover 18 is press-fitted into the spot facing 21 of said head body 16, using a press device or the like, whereby the side face 23 of the cover 18 and the side face 22 of the spot facing 21 are dovetailed together, thus fixing rigidly the cover 18 to the head body 16, through plastic deformation at the time of the press-fitting.

According to the structure of the foregoing embodiment, as the back 3 of the head body 16 is formed with the concave portion 19 into which is fitted the metallic balance weight 17 made of the material of the specific gravity smaller than that of the head body 16, a sharp feeling in striking balls similar to the one obtained when using a muscle back type having no concave portion at its rear side can be obtained. Further, so-called strong balls can be struck with such golf club, and the whole head body 16 can be enlarged owing to the comparatively light weight of the balance weight 17, and the weight of the head 1 can be distributed more toward the periphery thereof relative to the face 2. Thus, a sweet area can be enlarged.

Moreover, as the cover 18 made of the material denser than that of the balance weight 17 is disposed rearwardly of the balance weight 17 relative to the head body 16, the center of gravity of the whole head 1 is located still rearwards, in other words, the depth of the center of gravity thereof is made still greater, so that a sweet area is enlarged further.

Additionally, as the cover 18 is joined to the head body 16 in a dovetail joint by press processing, the cover 18 can be fixed to the head body 16 rigidly, with no failures. Therefore, during the use thereof, there is no likelihood of the cover 18 and even the balance weight 17 coming off from the head body 16 due for example to the impacts accompanying the striking of balls. In addition, restrictions on the selection of the respective materials of the head body 16 and cover 18 will be lessened, as compared with welding or the like. Also, there will occur no problems of the loss in attractiveness due to welding marks and pin holes resulting from the welding and the fixing with screws.

In addition to the foregoing, as the materials of the head body 16 and the cover 18 are the same iron-based material in this embodiment, a whole-face plating is possible in the case of performing antirust plating and the like, thus obviating the masking works for masking some portions unsuitable for plating. In contrast, with the combination of the said head body made of iron-based material and the balance weight made of titanium-based material, without the cover of the foregoing embodiment, plating materials normally do not adhere to titanium-based materials, and thus it would be necessary to mask the titanium-based materials prior to the plating works for preventing the staining or damaging of the same, and then to strip off the masking after the plating.

Incidentally, various materials may be used, as mentioned above, for the materials of the above-mentioned head body 16, the balance weight 17 and the cover 18. When the material of the cover 18 is selected so as to be denser than that of the head body 16, such as beryllium copper or tungsten, then the center of gravity of the whole head 1 will be positioned further backward, or in other words, the depth of the center of gravity will be made greater, whereby a sweet area can be widened even further.

Figure 4:
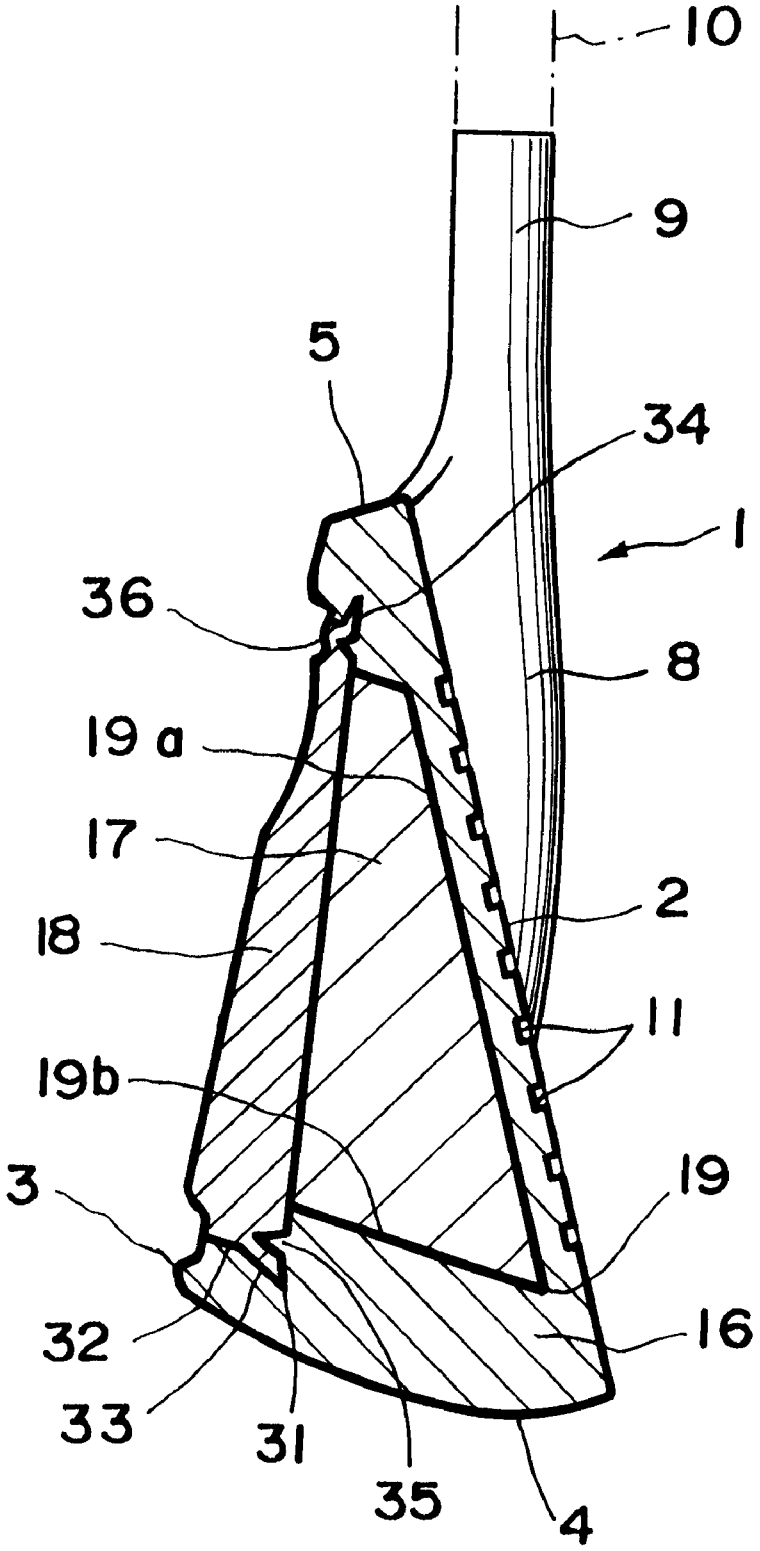
FIG.4 is a section showing a second embodiment of a golf club of the invention.

FIG.4 shows a second embodiment of a golf club of the present invention. The same portions as those described in a first embodiment will be designated as common reference numerals, and their explanation will be omitted.

A second embodiment shows a modified example of the means for joining the cover 18 to the head body 16. In a second embodiment also, the cover 18 is joined to the head body 16 by press processing, with a spot facing 31 for press-fitting the cover 18 thereto being formed along the entire periphery of the concave portion 19 at the back 3 side of the head body 16.

The spot facing 31 has a side face which comprises a pole face 32 at its rear side and a reverse-tapered face 33 at its front or bottom side whose spanwise dimension gets smaller in the front-to-back direction. Further, there is provided a sharp projection 35 formed on the front or bottom face 34 of the spot facing 31. The cover 18 is then press-fitted into the facing 31 of the head body 16, using a press device and the like. At that time, the projection 35 of the head body 16 cuts into the cover 18 through plastic deformation, while the front part of the side face 36 of the cover 18 engages with the reverse-tapered face 33 of the spot facing 31 in a dovetail joint. Thus, the cover 18 is fixed to the head body 16 more rigidly and securely.

Figure 5:
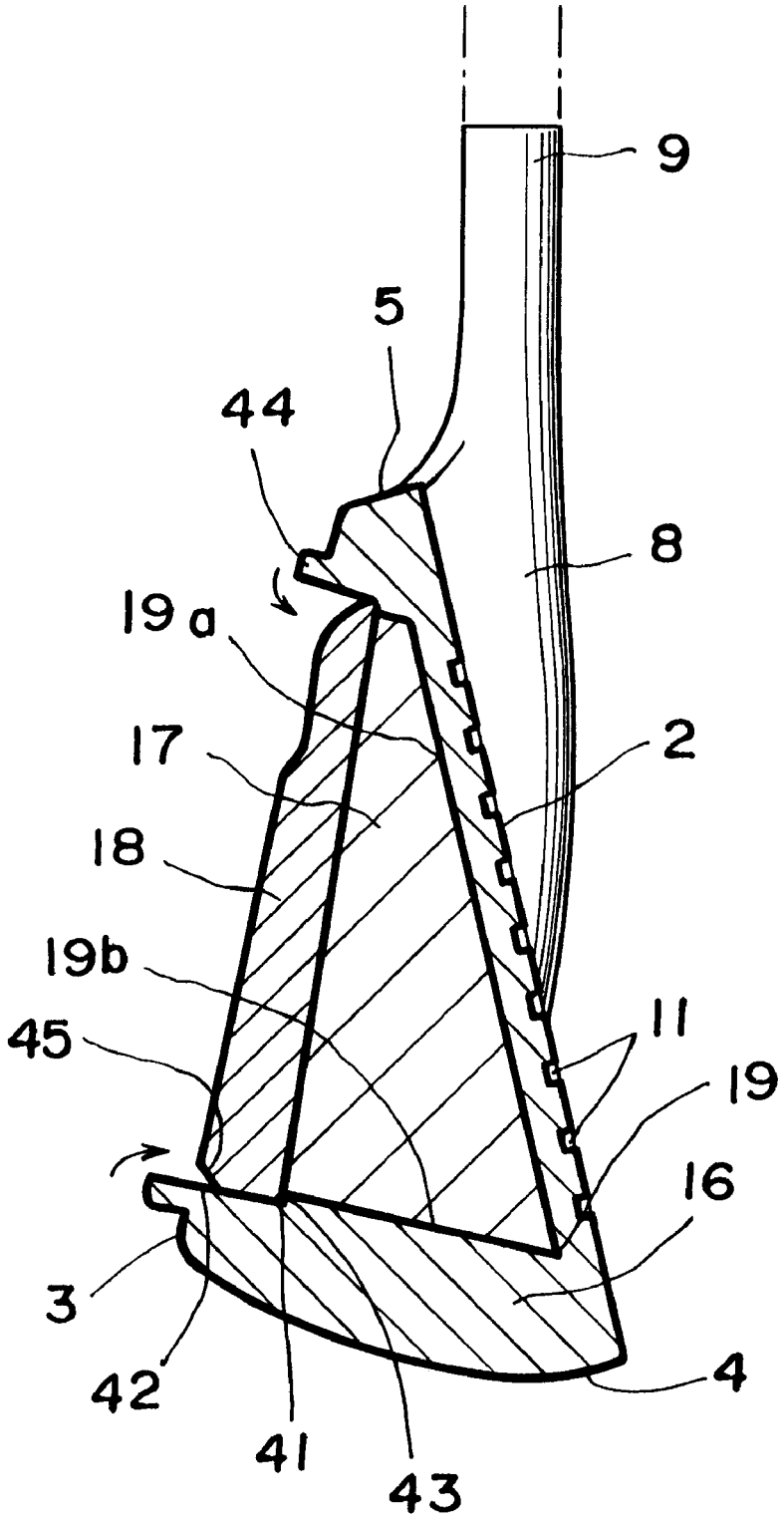
FIG.5 is a section showing a third embodiment of a golf club of the invention, illustrating a head body and a cover which are prior to being joined each other.
Figure 6:
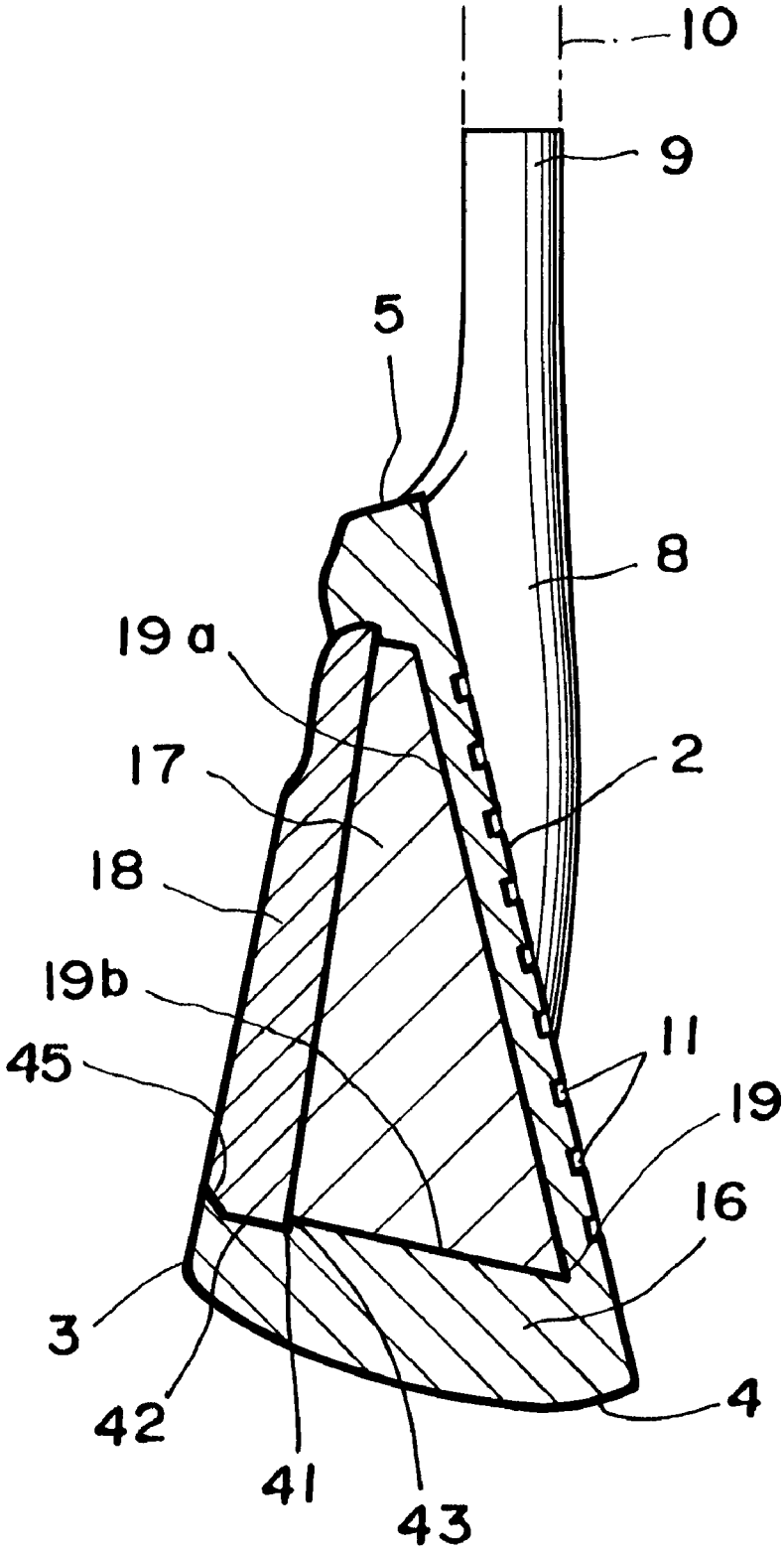
FIG.6 is also a section showing the third embodiment, illustrating a head body with a cover body joined thereto.

FIGS.5 and 6 show a third embodiment of a golf club of the present invention. The explanation of the same portions described in the foregoing embodiments will be omitted, with the same reference numerals attached.

The third embodiment shows another modified example of the means for joining the cover 18 to the head body 16. In the third embodiment also, the cover 18 is joined to the head body 16 by press processing, with a spot facing 41 for press-fitting the cover 18 thereto being formed along the entire periphery of the concave portion 19 at the back 3 side of the head body 16.

Prior to joining the cover 18, the spot facing 41 has a side face 42 which is pole-shaped or cylindrical and intersects with a bottom face 43 of the spot facing 41 at right angles, as illustrated in FIG.5. Further, there is provided a protrusion 44 on the back surface of the head body 16 in the periphery of the spot facing 41. On the other hand, a side face of the cover 18 is at least formed with a tapered face 45 whose spanwise dimension gets smaller toward the rear.

When fixing the cover 18 to the head body 16, the cover 18 is fitted into the spot facing 41 of the head body 16, and then the protrusion 44 of the head body 16 is plastically deformed, using a press device, as illustrated by arrows of FIG.5, so as to cover the tapered face 45 of the cover 18 therewith, as shown in FIG.6. Thus, the head body 16 and the cover 18 are dovetailed together, thereby rigidly and securely fixing the cover 18 to the head body 16. The third embodiment is particularly advantageous in the case of the material of the cover 18 being less plastically deformable than that of the head body 16.

The present invention should not be limited to the foregoing embodiments but may be modified in various ways. For example, although the concave portion 19 in the foregoing embodiments are formed by machining, it may be formed by either forging alone or casting alone. Further, the means for joining the balance weight and the cover to the head body should not be limited to those described in the embodiments, but may be structured in other various ways.

What is claimed:

1. A golf club incorporating a head having a shaft connected to one side and a face on a front, wherein said head comprises:

a metallic head body having a hollow portion formed by a cavity opening to a spot facing in a rear face, with a peripheral portion of said rear face being disposed around said spot facing;

a metallic balance weight fitted into the cavity of said head body; and a metallic cover joined to a rear side of said head body so as to cover said balance weight, said cover being fitted into the spot facing so that the cover is nearly flush with the rear face of the head body, wherein said cover is made of the same material as that of the head body;

wherein the specific gravity of a material of said balance weight is smaller than that of a material of said head body, the specific gravity of the material of said balance weight being seven or less, while the specific gravity of a material of said cover is at least equal to that of the material of said head body.

2. A golf club according to claim 1, wherein the material of said balance weight is either titanium or titanium alloy.

3. A golf club according to claim 1, wherein said cover and said head body are made of an iron-based material.

4. A golf club according to claim 3, wherein the whole face of said head is plated.

5. A golf club according to claim 1, wherein said spot facing is reverse tapered and a taper face corresponding to the side face of said spot facing is formed on the side face of the peripheral portion of said cover, and said cover is pressed into said spot facing of said head body, to thereby join said cover to said head body.

6. A golf club according to claim 5, wherein a sharp projection is formed on the bottom face of said spot facing, said projection being cut into said cover.

7. A golf club according to claim 1, wherein a taper face is formed on the side face of the periphery of said cover, and the spot facing of the head body is made to cover the taper face of said cover by plastic deformation of said head body, to thereby join said cover to said head body.

8. A golf club according to claim 1, wherein said cavity is formed by machining, having an undercut shape with a front face and lower face thereof intersecting at an acute angle.

9. The golf club according to claim 1, wherein the metallic balance weight substantially fills the cavity of said head body.

* * * * *